US005791827A

United States Patent [19]

Arvai et al.

[11] Patent Number: 5,791,827

[45] Date of Patent: Aug. 11, 1998

[54] CONCRETE RETAINING WALL BUILT FROM STACKED CONCRETE BLOCKS OF DIFFERENT CONFIGURATIONS

[76] Inventors: Louis Arvai, P.O Box 666, West Lorne, Ontario; Charles Chase, 122 Furnival Rd., Rodney, Ontario, both of Canada

[21] Appl. No.: 553,826

[22] Filed: Nov. 6, 1995

Related U.S. Application Data

[63] Continuation of Ser. No. 227,615, Apr. 14, 1994, abandoned.

[51] Int. Cl.[6] ..... E02D 29/02

[52] U.S. Cl. ..... 405/286; 405/284; 405/31; 52/604; 52/606

[58] Field of Search ..... 405/30–31, 284–286, 405/262; 52/604, 606, 592.6, 169.5, 302.1, 609

[56] References Cited

U.S. PATENT DOCUMENTS

| | | | |
|---|---|---|---|
| 672,044 | 4/1901 | Staples | 52/606 X |
| 701,588 | 6/1902 | Liebau | 52/606 X |
| 1,790,110 | 1/1931 | Nygaard et al. | 52/606 X |
| 2,225,612 | 12/1940 | Allen | 20/0.5 |
| 2,313,363 | 3/1943 | Schmitt | 61/39 |
| 2,706,109 | 4/1955 | Ödman | 263/51 |
| 2,727,382 | 12/1955 | Waldsee | 72/41 |
| 2,786,301 | 3/1957 | Toricelli | 46/25 |
| 2,963,828 | 12/1960 | Belliveau | 50/425 |
| 3,305,982 | 2/1967 | Steele | 52/90 |
| 3,731,448 | 5/1973 | Leo | 52/594 |
| 4,091,585 | 5/1978 | Rudichuk | 52/274 |
| 4,175,888 | 11/1979 | Ijima | 405/31 |
| 4,413,924 | 11/1983 | Ijima | 405/31 |
| 4,490,075 | 12/1984 | Risi et al. | 405/273 |
| 4,711,606 | 12/1987 | Leling et al. | 405/286 |
| 4,815,897 | 3/1989 | Risi et al. | 405/284 |
| 4,896,999 | 1/1990 | Ruckstuhl | 405/286 |
| 4,909,010 | 3/1990 | Gravier | 52/609 |
| 4,964,761 | 10/1990 | Rossi | 405/286 |
| 4,993,206 | 2/1991 | Pardo | 52/589 |
| 5,064,313 | 11/1991 | Risi et al. | 405/284 |

FOREIGN PATENT DOCUMENTS

| | | | |
|---|---|---|---|
| 479616 | 12/1951 | Canada . | |
| 753419 | 2/1967 | Canada . | |
| 798042 | 11/1968 | Canada . | |
| 968726 | 6/1975 | Canada . | |
| 1097512 | 3/1981 | Canada . | |
| 1182295 | 2/1985 | Canada . | |
| 1204296 | 5/1986 | Canada . | |
| 1263815 | 12/1989 | Canada . | |
| 233123 | 9/1988 | Japan | 405/286 |

*Primary Examiner*—Tamara L. Graysay
*Assistant Examiner*—Frederick L. Lagman
*Attorney, Agent, or Firm*—Arnold, White & Durkee

[57] ABSTRACT

A novel concrete block having six generally planar faces to provide a retaining wall for retaining a bank of earth. The retaining wall includes a lower tier of a plurality of separate abutting bottom blocks; an intermediate tier of a plurality of separate abutting intermediate blocks; and at least one upper tier of a plurality of separate abutting blocks. Each concrete block of each tier has six generally-planar faces, consisting of two planar end faces, a front planar face and a rear planar face, the front planar face and the rear planar face having a plurality of drainage ducts extending therebetween, an upper planar face and a lower planar face. Each upper planar face differs from the lower planar face of each block by a particular recited structure. As well, particularly defined locking interrelationships are provided between the individual blocks of the tiers of blocks.

13 Claims, 4 Drawing Sheets

CONCRETE RETAINING WALL BUILT FROM STACKED CONCRETE BLOCKS OF DIFFERENT CONFIGURATIONS

This application is a continuation of application Ser. No. 08/227,615, filed Apr. 14, 1994, now abandoned.

BACKGROUND OF THE INVENTION (i) Field of the Invention

This invention relates to novel concrete block gabion-type structures.

(ii) Description of the Prior Art

Traditionally, and conventionally, a "gabion" is a rectangularly-shaped container made from woven wire mesh. The gabion may be made in any desired length or width. Such gabion may generally be fabricated from a plurality of substantially planar wire mesh panels which are interconnected with each other by a spiral coil of wire that is coiled about adjacent parallel wires at matching edges of the panels of the gabion. The wire mesh container is filled with rocks usually taken from the gabion site. It has been proposed to use such "gabions", which are formed from panels of metal netting and ties that are resistant to corrosion and mechanical stress, for earth stabilization.

Gabions are used to prevent land erosion along streams and rivers, to retain walls along highways and railroads, to provide supports for bridges and piers and other similar uses. These various uses include weirs, revetments, groins and dams. Thus, gabions have been used as a covering or other protective structures for preventing soil erosion caused by surface water and infiltration, and for consolidating soil against landslides in the building of river embankments, lakeside, coastal and mountain side earthworks, road construction and similar works.

Another known approach to such protective systems makes use of special "mattress gabions", that is to say multiple-compartment containers able to cover, without any special continuity problems, very large expanses of ground, protecting them from erosion and consolidating them against landslides as indicated above. The dimensions of such containers are chosen such that are of notably greater length than width, and of a height notably less than their length and width. These boxes or containers, can be composed of a panel or "base sheet" destined to form the bottom, longitudinal and transverse walls of the boxes and of a plurality of secondary sheets shaped and set out to form the transverse partitions dividing the inside of the box into a plurality of compartments, which are in turn upwardly closed by a "cover sheet".

Many problems have arisen with the use of wire gabions. They are tedious to use and time consuming to erect and use. It is these difficulties, among others, which the present invention seeks to overcome.

There are soil erosion control problems which are not solvable by the use of wire gabions. It is known that the character of the sea bottom adjacent a beach may focus waves propagating landward, concentrating their energy on promontories, capes, and headlands when the contours of the sea bottom are curved about centres in such land masses. Heretofore, attempts to protect such headlands by the erection of masonry walls rising from deep foundations in the beach have failed to provide long term protection, since under high water conditions the run-up of the breaking waves results in greatly aggravated erosion of the bottom at the foot of the wall. Solid walls reflect incident waves, producing high hydraulic pressures on the entire wall area and generating strong currents that scour the beach and undermine the structure. Solid seawalls may be destroyed completely in a single violent storm. Any solid seawall designed to withstand repeated assaults by waves would have to extend a very considerable distance below ground in order that currents developed by wave doubling on reflection could not excavate beneath the structure. Such solid wall breakwaters would be exorbitant in cost and would always have the disadvantage of inciting clapotis in the sea at high water, and would moreover form an unsatisfactory beach from which all fine sands were removed. The strand between a typical headland jutting into the sea and the low water line tends over a period of geologic time to become largely a residue of shingle and stone pulled down from a resistant cliff or escarpment, against which waves break at high water, producing eroding under-pressures and bottom currents that remove the finer particles.

In order to avoid the inherent problem of wire gabions, the art had provided beach-conserving sea wall structures. Canadian Patent No. 753,419, patented Feb. 28, 1967 by G. E. Jarlan taught masonry or concrete structures erected between a beach and a headland for conserving the beach sand covering which otherwise would be stripped from the strand at high water under strong wave action. The invention in this Canadian Patent No. 753,419 consisted in a protective seawall structure sited between a headland or promontory and the low water shoreline, the sea wall having a seaward-facing vertical wall resting upon the beach and spaced from a solid landward wall coextensive horizontally and vertically with the seaward wall and rising above the highest water level, the seaward-facing wall being extensively perforated by horizontal transverse ducts uniformly spaced over its upper elevational surface area.

Other patents also taught concrete retaining wall structures. Canadian Patent No. 1,097,512, patented Mar. 17, 1981 by E. Heinzmann, provided an inclined retaining wall for retaining and securing the slope of an inclined piece of terrain. The wall included a plurality of horizontal rows of prism-shaped elements, superimposed one upon the other in a relationship staggered rearwardly in an upward direction.

Canadian Patent No. 1,182,295 patented Feb. 12, 1985 by A. Risi, provided interlocking precast concrete structures and headers from which a wall system or cribbing and other related useful structures could be built. The patented interlocking block provided a retaining wall structure wherein like blocks were laid in horizontal courses one upon the other in end to end relation, with the upper blocks interlocking with the lower blocks and displaceable therealong in sliding fit and therebeyond to overlap the adjacent ends of the lower blocks and to extend upwardly as the wall structure was erected.

U.S. Pat. No. 4,413,924 patented Nov. 8, 1983 by T. Izima, provided blocks for constructing a breakwater having a front wall, a rear wall disposed in parallel and spaced-apart relationship relative to the front wall, and at least one partition wall disposed perpendicular to the front and rear walls and integrally connecting those two walls to form at least one vertical open-ended chamber between the front and rear walls. In such structure, at least one vertical open-ended hole was formed in the same manner on front and rear walls of the blocks in upper and lower rows when the blocks were arranged in rows and stacked vertically.

U.S. Pat. No. 4,175,888 patented Nov. 27, 1979 provided a block for constructing a breakwater having a front wall provided with a horizontal hole, an intermediate wall, a rear wall and a pair of spaced-apart longitudinal walls which were disposed perpendicular to the above three walls for integrally connecting the three walls. The walls provided an open-ended chamber between the front and intermediate walls and an open-ended chamber between the intermediate and rear walls. The front wall had both a horizontal hole disposed in the central portion thereof and had end cut-out portions disposed at both sides thereof.

U.S. Pat. No. 5,064,313 patented Nov. 12, 1991 by A. Risi et al, provided improvements in the control and stabilization of earthen or soil embankments comprising a gravity facing wall tied to, and anchored by, a grid or mesh extending into the embankment. The gravity facing wall was composed of facing wall units or blocks stacked in overlapping horizontal courses. The block included a projection formation extending longitudinally of the block in the upper surface and, in the lower surface, an offset recess of matching extent and configuration to the projection formation.

It is appreciated that building blocks having interlockable components thereon are known in the art. For example:

Canadian Patent No. 479,610 patented Dec. 25, 1951 by J. A. Bullen, provided a building block comprising a body having two opposite major faces, and four bounding edge faces. A bead extended along and outwardly from two adjoining edge faces and was adjacent to one of the major faces. It had longitudinally-spaced projections on the vertical and horizontal edge faces which were furnished with the bead, and recesses spaced in the remaining bounding edge faces.

Canadian Patent No. 798,042 patented Nov. 5, 1968 by J. R. Caterina, provided a self-levelling, self-aligning building module which included two projections at the top face of the element and two recessions at the bottom face of the element. The projections at one face were arranged in a specified manner relative to the recessions at the other face.

U.S. Pat. No. 4,993,206 patented Feb. 19, 1991 by J. Pardo, provided interfitting modular construction units including alternating plateaus and recesses which interfit with one another to form walls without mortar. Drainage grooves were included in the units, bevels were provided on the perimeter of the front and back to give a brickface appearance to the wall, and shear notches were provided just behind the front and back.

SUMMARY OF THE INVENTION (i) Aims of the Invention

Yet none of the patents referred to above provide the combination of interengageable stackable components of concrete retaining wall blocks which also include a plurality of transverse ducts therethrough. None of these structures provided a teaching of a concrete block for providing a block-like gabion.

It is thefore the primary object of this invention to provide a block which can be used for earth stabilization.

It is another object of this invention to provide such a block which can be used to prevent land erosion along streams and rivers.

It is yet another object of this invention to provide such a block which can be used to provide wiers, revetments, and groins.

It is still another object of this invention to provide such a block which can be used to provide a structure for protecting a land mass subject to wave attack.

It is also an object of this invention to provide a block which can provide a perforated sea wall.

Another object of this invention is to provide an improved embankment reinforcing structure that includes a stable retaining wall or gravity facing wall derived from a plurality of interlocking overlapping stackable facing wall units or blocks or panels.

(ii) Statement of Invention

By this invention, a retaining wall is provided for retaining a bank of earth, the retaining wall comprising: a lower tier of a plurality of separate abutting blocks, and an upper tier of a plurality of separate abutting blocks. In such retaining wall, each block of the lower tier of abutting blocks comprises a concrete block having six generally-planar faces, consisting of two planar end faces, a front planar face and a rear planar face, the front planar face and the rear planar face having a plurality of drainage ducts extending therebetween, an upper planar face and a lower planar face, the upper planar face differing from the lower planar face by including a shelf cantilevered over the rear face thereof and a locking cap adjacent the front face thereof, the locking cap extending between the two planar end faces, the locking cap comprising either (i) an upwardly-extending lock curb terminating in a lock face, the lock face being spaced from, but being proximate to, the front face of the block; or (ii) an upwardly-sloping ramp terminating in an abutment face which is disposed a predetermined distance between the rear face and the front face. In such retaining wall, each block in the upper tier of blocks comprises a concrete block having six generally-planar faces consisting of two planar end faces, a front planar face and a rear planar face, the front planar face and the rear planar face having a plurality of drainage ducts extending therebetween, an upper planar face and a lower planar face, the upper planar face differing from the lower planar face by including a locking cap extending between the two planar end faces, the locking cap comprising either (iii) an upwardly-sloping ramp terminating in an abutment face which is disposed a predetermined distance between the rear face and the front face; or (iv) an upwardly-extending lock curb which terminates in a lock face, the lock face being spaced from, but being proximate to, the front face of the block. The tiers of blocks are held in locking cooperation as follows: the locking cooperation between the separate blocks in the upper tier of blocks which are juxtaposed atop associated separate blocks of the lower tier of blocks, comprises the lower face of each separate intermediate block which is adjacent the rear face thereof being supported on the cantilevered shelf of an associated lower separate block, and the front edge, which intersects the front face and the bottom face of the associated separate lower block, being abutted either against (v) the back face of the locking cap of the lower block, or against (vi) the abutment face of the upwardly sloping ramp of the locking cap of the associated separate lower block.

A retaining wall is provided for retaining a bank of earth, the retaining wall comprising: a lower tier of a plurality of separate abutting bottom blocks, an intermediate tier of a plurality of separate abutting intermediate blocks, and an upper tier of a plurality of separate abutting upper blocks. In such retaining wall, each block of the lower tier of abutting blocks comprises a concrete block having six generally-planar faces, consisting of two planar end faces, a front planar face and a rear planar face, the front planar face and the rear planar face having a plurality of drainage ducts extending therebetween, an upper planar face and a lower planar face, the upper planar face differing from the lower planer face by including a shelf cantilevered over the rear face thereof and a locking cap adjacent the front face thereof, the locking cap extending between the two planar end faces, the locking cap comprising an upwardly-extending lock curb terminating in a lock face, the lock face being spaced from, but being proximate to, the front face of the block. In such retaining wall, each block in the intermediate tier of blocks comprises a concrete block having six generally-planar faces consisting of two planar end faces, a front planar face and a rear planar face, the front planar face and the rear planar face having a plurality of drainage ducts extending therebetween, an upper planar face and a lower planar face, the upper planar face differing from the lower planar face by including a locking cap extending between the two planar end faces, the locking cap comprising an upwardly-sloping ramp terminating in an abutment face which is disposed a predetermined distance between the rear face and the front face. In such retaining wall, each block in the upper tier of blocks comprises a concrete block having six generally-planar faces, consisting of two planar end faces, a front planar face and a rear planar face, the front planar face and the rear planar face having a plurality of drainage ducts extending therebetween, an upper planar face and a lower planar face, the upper planar face differing from the lower planar face by including a locking cap adjacent the front face, the locking cap extending between the two planar end faces, the locking cap comprising an upwardly-extending lock curb which terminates in a lock face, the lock face being spaced from, but being proximate to, the front face of the block. The tier of blocks are held in locking cooperation as follows: the locking cooperation between the separate blocks in the intermediate tier of blocks which are juxtaposed atop associated separate blocks of the lower tier of blocks, comprises the lower face of each separate intermediate block which is adjacent the rear face thereof being supported on the cantilevered shelf of an associated lower separate block, and the front edge, which intersects the front face and the bottom face of the associated separate intermediate block, being abutted against the back face of the locking cap of the lower block. The locking cooperation between the separate blocks in the upper tier of blocks, which are juxtaposed atop associated separate blocks of the intermediate tier of blocks, comprises the front edge which intersects the front face and the bottom face of the associated separate upper block, being abutted against the abutment face of the upwardly sloping ramp of the locking cap of the associated separate intermediate block.

The present invention also provides a retaining wall for retaining a bank of earth, the retaining wall comprising: a lower tier of a plurality of separate abutting bottom blocks, an intermediate-tier of a plurality of separate abutting intermediate blocks, a bottom upper tier of a plurality of separate abutting upper blocks, and a top upper tier of a plurality of separate abutting upper blocks. In such retaining wall, each block of the lower tier of abutting blocks comprises a concrete block having six generally-planar faces, consisting of two planar end faces, a front planar face and a rear planar face, the front planar face and the rear planar face having a plurality of drainage ducts extending therebetween, an upper planar face and a lower planar face, the upper planar face differing from the lower planar face by including a shelf cantilevered over the rear face thereof and a locking cap adjacent the front face thereof, the locking cap extending between the two planar end faces, the locking cap comprising an upwardly-extending lock curb terminating in a lock face, the lock face being spaced from, but being proximate to, the front face of the block. In such retaining wall, each block in the intermediate tier of blocks comprises a concrete block having six generally-planar faces consisting of two planar end faces, a front planar face and a rear planar face, the front planar face and the rear planar face having a plurality of drainage ducts extending therebetween, an upper planar face and a lower planar face, the upper planar face differing from the lower planar face by including a locking cap extending between the two planar end faces, the locking cap comprising an upwardly-sloping ramp terminating in an abutment face which is disposed a predetermined distance between the rear face and the front face. In such retaining wall, each block in the bottom upper tier of blocks comprises a concrete block having six generally-planar faces consisting of two planar end faces, a front planar face and a rear planar face, the front planar face and the rear planar face having a plurality of drainage ducts extending therebetween, an upper planar face and a lower planar face, the upper planar face differing from the lower planar face by including a locking cap adjacent the front face, the locking cap extending between the two planar end faces, the locking cap comprising an upwardly-extending lock curb which terminates in a lock face, the lock face being spaced from, but being proximate to, the front face of the block. In such retaining wall, each block in the top upper tier of blocks comprises a concrete block having six generally-planar faces consisting of two planar end faces, a front planar face and a rear planar face, the front planar face and the rear planar face having a plurality of drainage ducts extending therebetween, an upper planar face and a lower planar face, the upper planar face differing from the lower planar face by including a locking cap adjacent the front face, the locking cap extending between the two planar end faces, the locking cap comprising an upwardly-extending lock curb terminating in a lock face, the lock face being spaced from, but being proximate to, the front face of the block. The tier of blocks are held in locking cooperation as follows: the locking cooperation between the separate blocks in the intermediate tier of blocks which are juxtaposed atop associated separate blocks of the lower tier of blocks, comprises the lower face of each intermediate block, which is adjacent the rear face thereof, being supported on the cantilevered shelf of an associated lower separate block, and the front edge, which intersects the front face and the bottom face of the associated separate intermediate block, being abutted against the back face of the locking cap of the associated separate lower block. The locking cooperation between the separate blocks in the bottom upper tier of blocks which are juxtaposed atop associated separate blocks of the intermediate tier of blocks, comprises the front edge, which intersects the front face and the bottom face of the associated separate bottom upper block, being abutted against the abutment face of the upwardly sloping ramp of the locking cap of the intermediate block. The locking cooperation between separate blocks in the top upper tier of blocks, which are juxtaposed atop associated separate blocks of the bottom upper tier of blocks, comprises the front edge, which intersects the front face and the bottom face of the associates separate top upper block, being abutted against the back face of the locking cap of the associated separate bottom upper block.

(iii) Other Features of the Invention

By one other feature of this invention, the width of the locking curb which projects upwardly from the upper planar face of the associated separate lower block is equal to the width of the shelf on the upper planar face of the associated lower block which is cantilevered over the rear face of that lower block.

By another feature of this invention, the associated separate bottom upper blocks are one-half the width of the associated separate intermediate blocks.

By yet another feature of this invention, the associated separate bottom upper blocks are of the same width as the associated separate top upper blocks.

By still another feature of the invention, the bottom upper tier of blocks and/or the top upper tier blocks include integrally united soil anchors which are driven into undisturbed soil.

The invention also provides a concrete block having six generally-planar faces, and comprises two end planar faces; a front planar face and a rear planar face, such faces having a plurality of drainage ducts extending therebetween; an upper planar face and a lower planar face; and locking means provided by locking cooperation between means on the upper planar face of one block and means on the lower planar face of an upper juxtaposed block to lock the upper juxtaposed block to the lower block. Such locking means may comprise a cap that extends along the upper face of one block at the front face thereof and between the two planar side faces. The cap comprises an upwardly-sloping ramp terminating in an abutment face spaced at a predetermined distance from the rear face of the block. The locking cooperation being between the abutment face of the ramp and the leading edge of the front planar face adjacent to the lower face of the upper juxtaposed block.

The invention also provides a concrete block having six generally-planar faces, and comprises two end planar faces; a front planar face and a rear planar face, such faces having a plurality of drainage ducts extending therebetween; an upper planar face and a lower planar face: and a locking cap to lock the upper juxtaposed block to the lower block. The locking cap extends along the upper face of one block at the front face thereof and between the two planar side faces. The cap comprises an upwardly-extending lock curb terminating in a lock face proximate to the front face of the block. The locking cooperation is between the lock curb of one block and the leading edge of the front face adjacent to the lower face of an upper juxtaposed block.

The invention also provides a concrete block having six generally-planar faces and comprises two end planar faces, a front planar face and a rear planar face; such faces having a plurality of drainage ducts extending therebetween, an upper planar face and a lower planar face, and locking means to lock the upper juxtaposed block to the lower block. The locking means comprises a shelf cantilevered over the rear face thereof of the lower block, a locking cap extending along the upper face of one block at the front face thereof and extending between the two planar side faces. The locking cap comprises an upwardly-extending lock curb terminating in a lock face proximate to the front face of the block, and the locking cooperation is between the lock curb of one block and the leading edge of the front face adjacent to the lower face of an upper juxtaposed block, the rear edge of the upper juxtaposed block resting on the shelf.

The invention also provides a concrete block having six generally-planar faces and comprises two end planar faces; a front planar face and a rear planar face, such faces having a plurality of drainage ducts extending therebetween; an upper planar face and a lower planar face; and locking means provided by cooperation between means on the upper planar face of one block and means on the lower planar face of an upper juxtaposed block to lock the upper juxtaposed block to the lower block. Such locking means comprises interlockable projections on the upper planar face of one block and complementary interlockable recesses in the bottom planar face of another block. The locking cooperation is between interlockable projections on the upper planar face of a lower block and the complementary recesses in the bottom face of a juxtaposed upper block.

BRIEF DESCRIPTION OF THE DRAWINGS

In the accompanying drawings.

Figure 1:
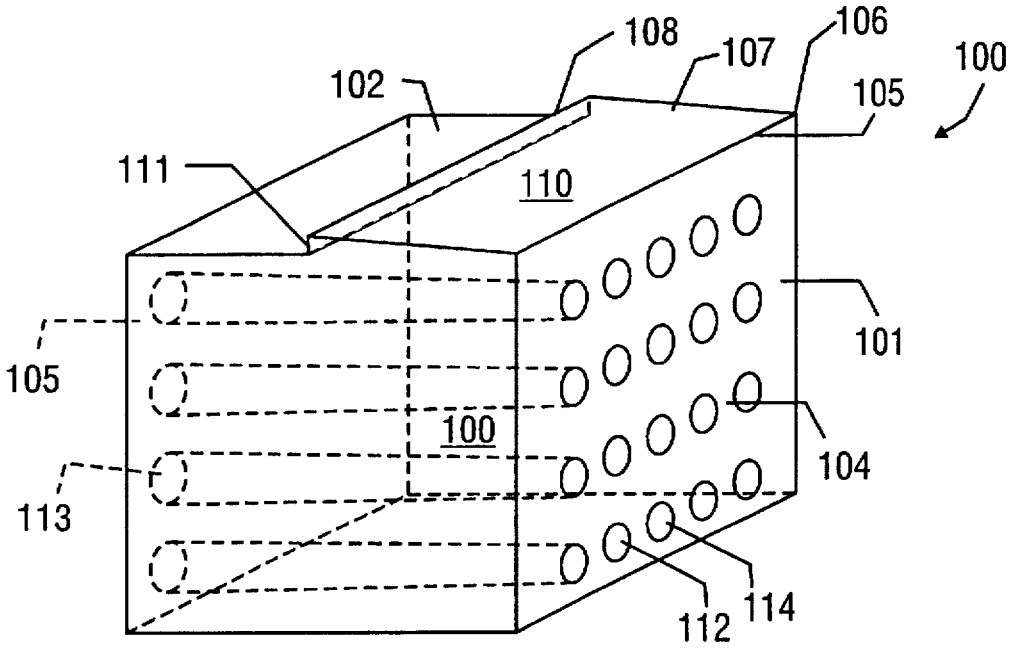
FIG. 1 is a perspective view of one block according to one embodiment of this invention.

DESCRIPTION OF PREFERRED EMBODIMENTS OF THE INVENTION (i) Description of FIG. 1

As seen in FIG. 1, this embodiment of the block 100 shows a cube 101 having an upper face 102, a lower face 103 (not seen but shown as broken lines), a front face 104, a rear face 105 (not seen but shown in broken lines, and two side faces 106 in one of which is shown). The upper face 102 is provided with a locking cap 107 constituted by an upper planar projection 108 at its leading edge 108, which is proximate the front face 104, and an upwardly sloping ramp 110 terminating at an abutment face 111. Locking cap 107 extends from one side face 106 to the other side face. The volume between the front face 104 and the rear face 105 is provided with a plurality of drainage ducts 112, whose diameter 113 at the rear face 105 is greater than the diameter 114 at the front face 104.

In one example of such block, the block is a cube, and the locking cap 107 includes a front planar face which extends to an abutment face. There are a plurality of drainage ducts, whose front face diameter is smaller then the rear face diameter. The locking cap 107 can be formed integral with the block to any desired offset from the front face 104.

Figure 2:
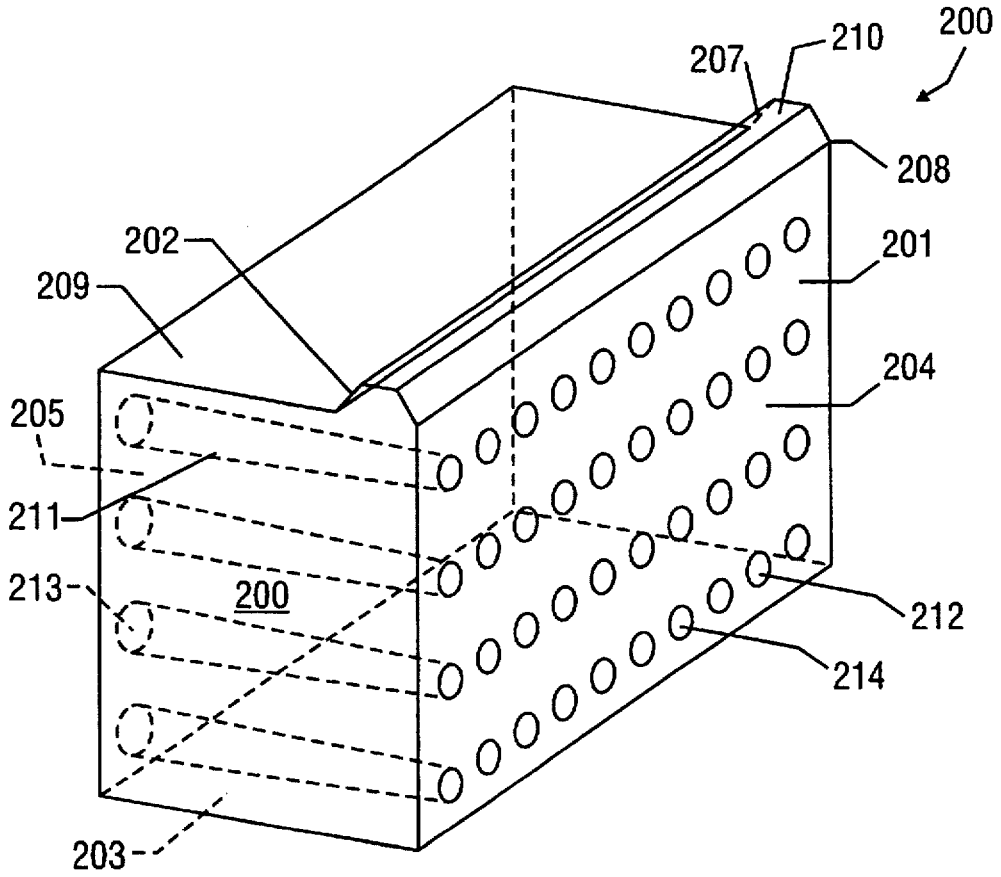
FIG. 2 is a perspective view of another block according to another embodiment of this invention.
Figure 3:
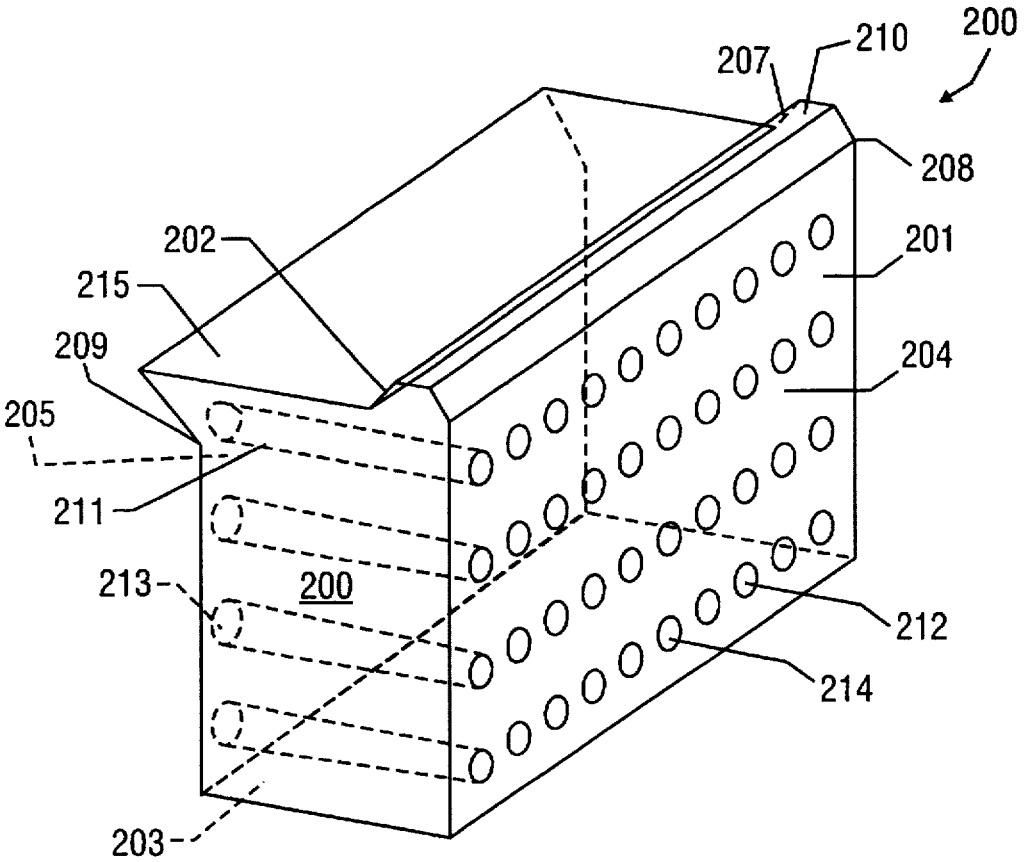
FIG. 3 is a perspective view of a modification of the block of the embodiment of the invention shown in FIG. 2.

(ii) Description of FIGS. 2 and 3

As seen in FIG. 2, that embodiment of the invention comprises a block 200 in the form of a rectangular parallelepiped 201 having an upper face 202, a lower face 203 (not seen but shown in broken lines), a front face 204, a rear face 205 (not seen but shown in broken lines), and two side faces 206 (only one of which is shown). The upper face 202 is provided with a lock curb 207 constituted by a trapezoidal-in-cross-section cap formed with a sloping front face 208, a sloping rear face 209 and a planar upper face 210. The lock curb 207 is provided at the leading edge 211 of the block 200 proximate the front face 204, with lock curb 207 extending from one side face 206 to the other side face. The volume between front face 204 and rear face 206 is provided with a plurality of draining ducts 212 whose diameter 213 at the rear face 205 is greater than its diameter 214 at the front face 204.

In the variant shown in FIG. 3, a shelf 215 is provided which is supported by unitary bracing 216. The block is an oblong parallelpiped. There are a plurality of drainage ducts, whose front face diameter is smaller than its rear face diameter.

Figure 4:
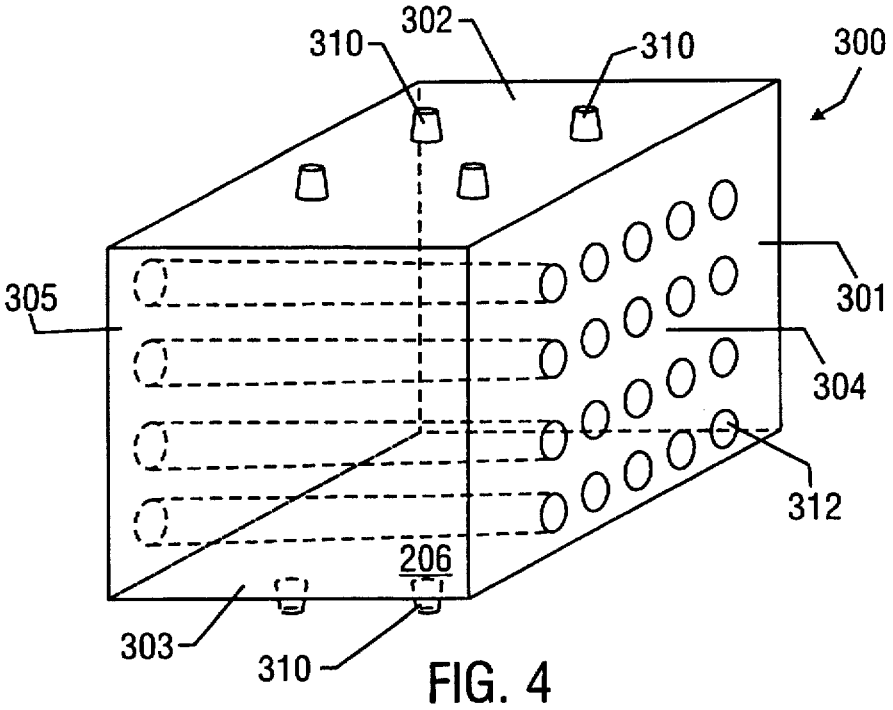
FIG. 4 is a perspective, right-hand side view of a block according to another embodiment of the present invention.

(iii) Description of FIG. 4

Each block 300 of this embodiment of this invention is generally a cube 301 and includes six generally-planar faces, i.e., an upper face 302, a bottom face 303 (not seen but shown as broken lines), a front face 304, a rear face 305 (not seen but shown as broken lines), and two side faces 306 (only one of which is seen). All faces are substantially planar. The front face 304 and the rear face 305, are also are pierced by a plurality of drainage ducts 312 extending completely therethrough between the front face 304 and the rear face 305. The diameter 313 of drainage ducts 312 at the rear face 305 is greater than the diameter 314 of the drainage ducts 312 at the front face 304. The upper face 302 is provided with a locking means 307 constituted by a plurality (in this case four) upstanding frusto-conical interlockable projections 309. The lower face 303 is provided with four aligned frusto-conical recesses 310 in the bottom face 303.

Figure 5:
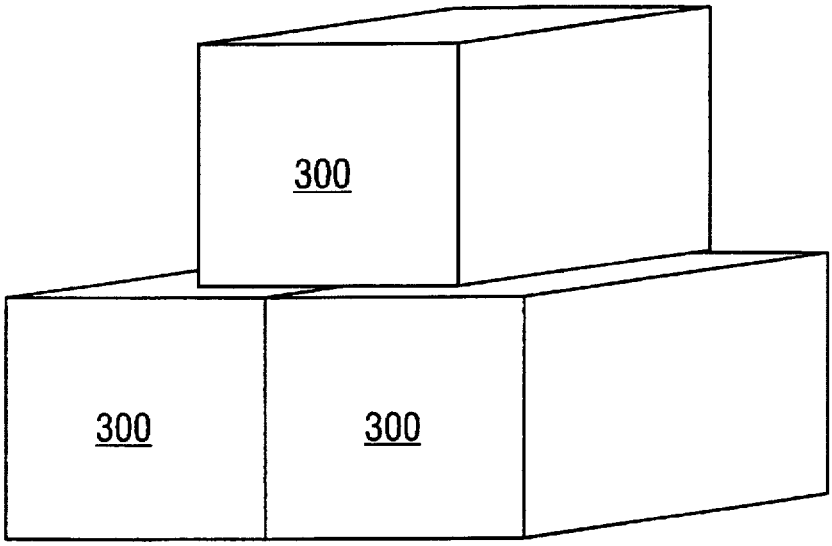
FIG. 5 is a perspective, left-hand side view of a stack of six retaining wall blocks of the embodiment FIG. 4 of the present invention.
Figure 6:
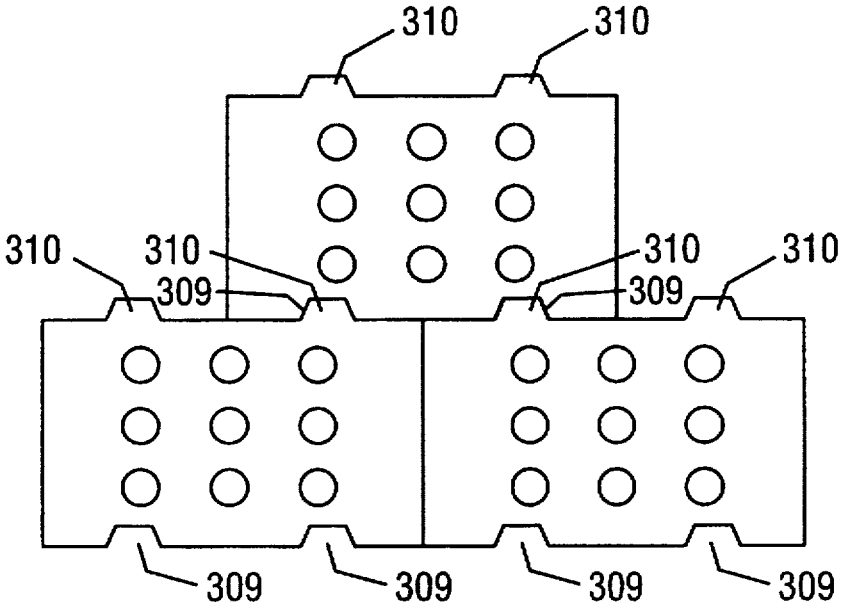
FIG. 6 is a central, longitudinal section through the stack of blocks of the present invention shown in FIG. 5.

(iv) Description of FIGS. 5 and 6

As seen in these FIGs. the blocks 300 are stacked one atop the other in staggered deployment with an upper block 300" straddling, and interconnecting, two lower blocks 300',300" by means of interlocking engagement between the upstanding frusto-conical projections 309 on the lower blocks 300 and the frusto-conical recesses 310 in the upper block 300".

Figure 7:
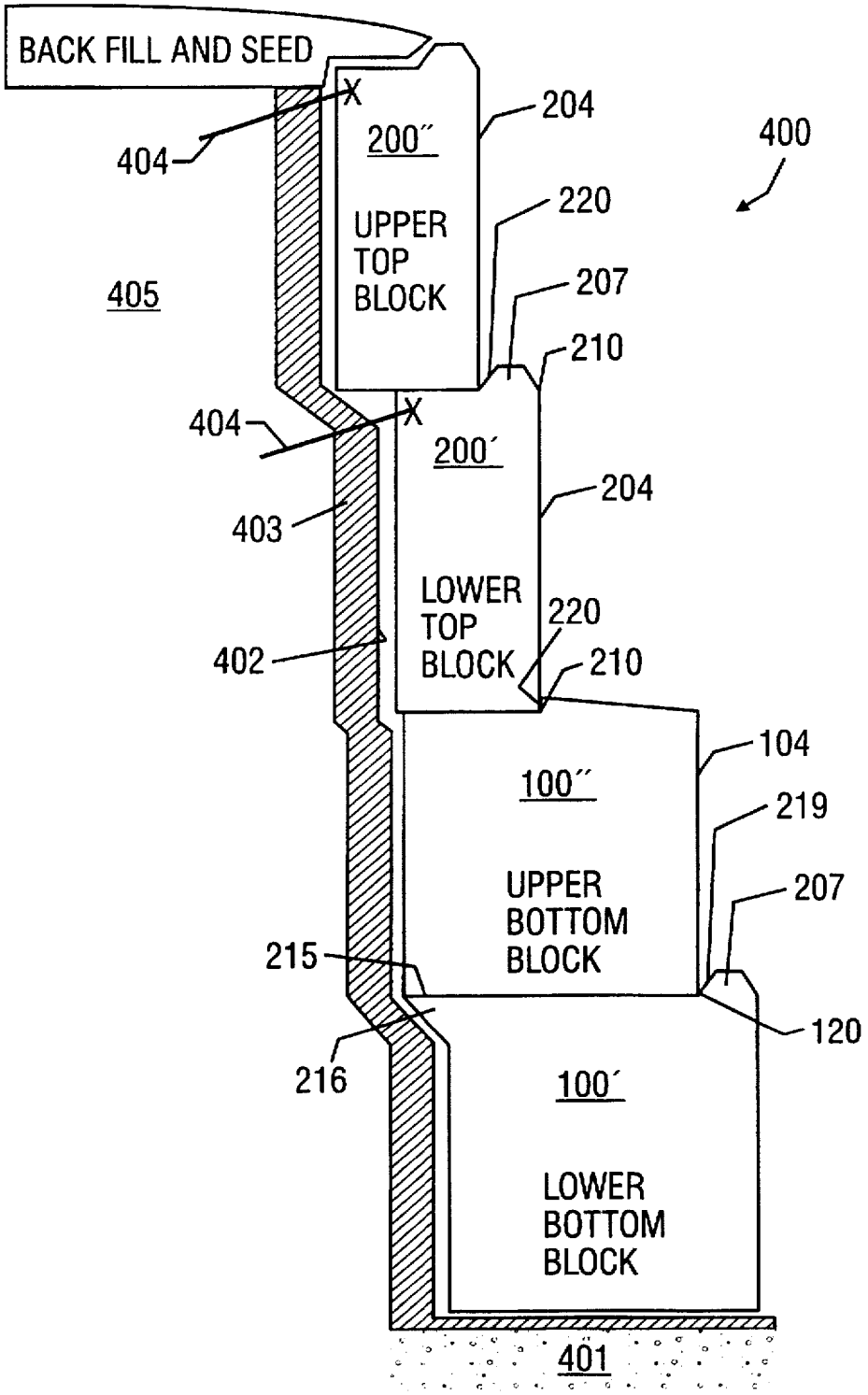
FIG. 7 is a central, vertical section through a retaining wall erected with a plurality of tiers of the blocks of the embodiments of FIGS. 1, 2 and 3 of the invention.

(v) Description of FIG. 7

FIG. 7 shows a vertical cross-section of a retaining wall 400 made up of two tiers of bottom blocks 100, i.e., lower bottom block 100', which is the block of the embodiment of FIG. 3, and upper bottom block 100", which is the block of the embodiment of FIG. 2, and two tiers of juxtaposed blocks 200, i.e. lower juxtaposed block 200' and upper juxtaposed block 200", each such block being the block of the embodiment of FIG. 1. The earth wall to be protected includes a base 401 of compacted crushed rock. The side faces are protected by a filter-cloth 402 retaining a face of clean stone or drainable sand 403.

The first tier of bottom blocks 100' is laid atop the base 401. A second tier of bottom blocks 100" is laid atop the first tier of bottom blocks 100' and are laterally offset with the leading edge 120 of the front face 104 of the second tier blocks 100", i.e., upper bottom blocks 100" abutting the abutment faces 209 of the locking curb 207 of the blocks 100', i.e., lower bottom blocks 100'. The rear portion of the tower face of upper bottom block 100" rests on the shelf 215.

A first tier of juxtaposed blocks 200, i.e., lower juxtaposed blocks 200' is laid atop the second tier blocks 100, i.e., upper bottom blocks 100", and are laterally offset by one half the width of the block with the leading edge 210 of the front face 204 of the lower upper juxtaposed blocks 200' abutting the abutment face 220 of the second tier blocks 100, i.e., the upper bottom blocks 100".

A second tier of juxtaposed blocks is laid atop the first tier of juxtaposed block 200', and are offset by one half the width of the block 200, i.e., upper juxtaposed blocks 200" are laid atop the first tier of juxtaposed blocks 200, i.e., lower juxtaposed blocks 200' with the leading edge 210 of the front face 204 of the second tier juxtaposed blocks 200, i.e., upper top juxtaposed blocks 200" abutting the lock curb 207 of the first tier juxta-posed blocks 200, i.e., the lower top juxta-posed blocks 200'.

The first and second tiers of juxtaposed blocks 200',200" are secured to the earth side faces by means of anchors 404, which are received into the blocks 200,200' and are driven, e.g., 3 feet into the undisturbed soil 405.

DESCRIPTION OF OPERATION OF PREFERRED EMBODIMENTS

The present invention thus provides a retaining wall structure which is a heavy, monolithic gravity unit able to withstand earth thrust. The building block method of construction also lends itself to unlimited flexibility of design. It offers the most technical and economical solutions to outstanding problems since it combines retaining and draining features. The blocks are quickly erected, are pervious to permit drainage of water through drainage ducts and are reinforced to tolerate settlement without fracture. Expensive, and sometimes dangerous, excavation for foundation is not required.

They are ideally suited for many installations since, when they are installed, their natural attractive appearance will blend with any location and surrounding. When installed as seawardly they can absorb surf and wave action and wave swash. They can also be used for the protection of bridge embankments and to build wing walls and supporting abutments for bridges carrying light traffic on highways as well as in parks and rural areas.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

We claim:

1. A retaining wall for retaining a bank of earth, said retaining wall comprising:

(A) a lower tier of a plurality of separate abutting bottom blocks;

(B) at least one intermediate-tier of a plurality of separate abutting intermediate blocks; and (C) an upper tier of a plurality of separate abutting upper blocks; wherein (i) each block of said lower tier of abutting blocks comprises a concrete block having six generally-planar faces, consisting of two planar end faces, a front planar face and a rear planar face, said front planar face and said rear planar face having a plurality of drainage ducts extending therebetween, an upper planar face and a lower planar face, said upper planar face differing from said lower planar face by including a shelf cantilevered over the rear face thereof, and a locking cap adjacent said front face thereof, said locking cap extending between said two planar end faces, said locking cap comprising an upwardly-extending lock curb terminating in a lock face, said lock face being spaced from, but being proximate to, said-front face of said block;

(ii) each block in said at least one intermediate tier of blocks comprises a concrete block having six generally-planar faces consisting of two planar end faces, a front planar face and a rear planar face, said front planar face and said rear planar face having a plurality of drainage ducts extending therebetween, an upper planar face and a lower planar face, said upper planar face differing from said lower planar face by including a locking cap extending between said two planar end faces, said locking cap comprising an upwardly-sloping ramp terminating in an abutment face which is disposed a predetermined distance between said rear planar face and said front planar face; and (iii) each block in said upper tier of blocks comprises a concrete block having six generally-planar faces, consisting of two planar end faces, a front planar face and a rear planar face, said front planar face and said rear planar face having a plurality of drainage ducts extending therebetween, an upper planar face and a lower planar face, said upper planar face differing from said lower planar face by including a locking cap adjacent said front planar face, said locking cap extending between said two planar end faces, said locking cap comprising an upwardly-extending lock curb terminating in a lock face having a back face, said lock face being spaced from, but being proximate to, said front planar face of said block; wherein (iv) locking cooperation between said separate blocks in said at least one intermediate tier of blocks, which are juxtaposed atop associated separate blocks of said lower tier of blocks, comprises the lower face of each associated intermediate block which is adjacent said rear planar face of said associated intermediate block being supported on said cantilevered shelf of an associated lower block, and the front edge, which intersects the front planar face and the bottom planar face of said intermediate blocs, being abutted against said back face of said lock face of said lock curb of said associated lower block; and wherein (v) locking cooperation between said separate blocks in said upper tier of blocks, which are juxtaposed atop associated separate blocks of said at least one intermediate tier of blocks, comprises the front edge, which intersects the front planar face and the bottom planar face of said upper block being abutted against said abutment face of said upwardly sloping ramp of said locking cap of said associated intermediate block.

2. A retaining wall for retaining a bank of earth, said retaining wall comprising:

(A) a lower tier of a plurality of separate abutting bottom blocks;

(B) an intermediate-tier of a plurality of separate abutting intermediate blocks; and (C) a bottom upper tier of a plurality of separate abutting upper blocks; and (D) a top tier of a plurality of separate abutting upper blocks; wherein (i) each block of said lower tier of abutting blocks comprises a concrete block having six generally-planar faces, consisting of two planar end faces, a front planar face and a rear planar face, said front planar face and said rear planar face having a plurality of drainage ducts extending therebetween, an upper planar face and a lower planar face, said upper planar face differing from said lower planar face by including a shelf cantilevered over the rear planar face thereof and a locking cap which is adjacent to said front planar face of said associated lower block thereof, said locking cap extending between said two planar end faces, said locking cap comprising an upwardly-extending lock curb terminating in a lock face, said lock face being spaced from, but being proximate to, said front face of said associated block;

(ii) each block in said intermediate tier of blocks comprises a concrete block having six generally-planar faces consisting of two planar end faces, a front planar face and a rear planar face, said front planar face and said rear planar face having a plurality of drainage ducts extending therebetween, an upper planar face and a lower planar face, said upper planar face differing from said lower planar face by including a locking cap extending between two planar end faces, said locking cap comprising an upwardly-sloping ramp terminating in an abutment face which is disposed a predetermined distance between said rear planar face and said front planar face;

(iii) each block in said bottom upper tier of blocks comprises a concrete block having six generally-planar faces consisting of two planar end faces, a front planar face and a rear planar face, said front planar face and said rear planar face having a plurality of drainage ducts extending therebetween, an upper planar face and a lower planar face, said upper planar face differing from said lower planar face by including a locking cap which is adjacent said front planar face, said locking cap extending between said two planar side faces, said locking cap comprising an upwardly-extending lock curb terminating in a lock face, said lock face being spaced from, but being proximate to, said front planar face of said block; and (iv) each block in said top upper tier of blocks comprises a concrete block having six generally-planar faces consisting of two planar end faces, a front planar face and a rear planar face, said front planar face and said rear planar face having a plurality of drainage ducts extending therebetween, an upper planar face and a lower planar face, said upper planar face differing from said lower planar face by including a locking cap which is adjacent said front planar face, said locking cap extending between said two planar side faces, said locking cap comprising an upwardly-extending lock curb terminating in a lock face, having a back face, said lock face being spaced from, but being proximate to, said front planar face of said block; wherein (v) locking cooperation between said separate associated blocks in said intermediate tier of blocks, which are juxtaposed atop associated separate blocks of said lower tier of blocks, comprises said lower planar face of each separate intermediate block which is adjacent said rear planar face thereof being supported on said cantilevered shelf of an associated separate lower block, and the front edge, which intersects the front planar face and the bottom planar face of said associated intermediate block, being abutted against said back face of said locking curb of said associated lower block; wherein (vi) locking cooperation between said separate blocks in said bottom upper tier of blocks, which are juxtaposed atop associated separate blocks of said intermediate tier of blocks, comprises said front edge, which intersects said front planar face and said bottom planar face of said associated upper block being abutted against said abutment face of said upwardly sloping ramp of said locking cap of said associated intermediate block; and wherein (vii) locking cooperation between separate associated blocks in said top upper tier of blocks, which are juxtaposed atop associated separate bottom upper tier of blocks, comprises said front edge, which intersects said front planar face and the bottom face of said separate, associated, bottom upper block being abutted against said back face of said locking curb of said associated bottom upper block.

3. The retaining wall of claim 1 wherein the width of said locking curb which projects upwardly from said upper planar face of said lower block is equal to the width of the shelf on said upper face of said lower block which is cantilevered over said rear face of said associated lower block.

4. The retaining wall of claim 2 wherein the width of said locking curb which projects upwardly from said upper planar face of said lower block is equal to the width of the shelf on said upper face of said lower block which is cantilevered over said rear face of said associated lower block.

5. The retaining wall of claim 1 wherein said bottom upper blocks are one-half the width of said intermediate blocks.

6. The retaining wall of claim 2 wherein said bottom upper blocks and said top upper blocks are the same width.

7. The retaining wall of claim 2 wherein separate blocks of said bottom upper tier of blocks includes integrally-united, soil anchors which are driven into undisturbed soil 33.

8. The retaining wall of claim 3 wherein separate blocks of said top upper tier of blocks includes integrally-united, soil anchors which are driven into undisturbed soil.

9. A retaining wall for retaining a bank of earth, said retaining wall comprising:

(A) at least one lower tier of a plurality of separate abutting bottom blocks; and (B) at least one upper tier of a plurality of separate abutting upper blocks; wherein (i) each block of said at least one lower tier of abutting blocks comprises a concrete block having six generally-planar faces, consisting of two planar end faces, a front planar face and a rear planar face, said front planar face and said rear planar face having a plurality of drainage ducts extending therebetween, an upper planar face and a lower planar face, said upper planar face differing from said lower planar face by including a shelf cantilevered over the rear face thereof, and a locking cap adjacent said front face thereof, said locking cap extending between said two planar end faces, said locking cap comprising (a) an upwardly-extending lock curb terminating in a lock face, said lock face being spaced from, but being proximate to, said front face of said block, or (b) an upwardly-sloping ramp terminating in an abutment face which is disposed a predetermined distance between said rear planar face and said front planar face;

(ii) each block in said at least one upper tier of blocks comprises a concrete block having six generally-planar faces, consisting of two planar end faces, a front planar face and a rear planar face, said front planar face and said rear planar face having a plurality of drainage ducts extending therebetween, an upper planar face and a lower planar face, said upper planar face differing from said lower planar face by including a locking cap adjacent said front planar face, said locking cap extending between said two planar end faces, said locking cap comprising (c) an upwardly-extending lock curb terminating in a lock face having a back face, said lock face being spaced from, but being proximate to, said front planar face of said block, or (d) an upwardly-sloping ramp terminating in an abutment face which is disposed a predetermined distance between said rear planar face and said front planar face; and wherein (iii) locking cooperation between said separate blocks in said at least one upper tier of blocks, which are juxtaposed atop associated separate blocks of said at least one lower tier of blocks, comprises the lower face of each associated intermediate block which is adjacent to said rear planar face of said associated intermediate block being supported on said cantilevered shelf of an associated lower block, and the front edge, which intersects the front planar face and the bottom planar face of said intermediate block, being abutted against (e) said back face of said lock face of said lock curb of said associated lower block, or against (f) said abutment face of said upwardly sloping ram of said locking cap of said associated lower block.

10. A concrete block for use in an earth retaining wall having a plurality of such blocks, said block having six generally planar faces, and comprising: two end planar faces; a front planer face and a rear planar face, such front an rear faces having a plurality of drainage ducts extending therebetween; an upper planar face and a lower planar face; a locking member extending upwardly from the upper planar face and adapted to cooperate with the lower planer face of an upper juxtaposed block to restrict relative horizontal movement between said block and the upper block; said locking member comprising an upwardly extending lock curb terminating in a lock face said lock face being spaced from but being proximate to, said front face of an upper juxtaposed block to restrict relative horizontal movement between said block and the upper block.

11. The block of claim 10 wherein said drainage ducts have a larger opening at the rear face than at the front face.

12. The concrete block according to claim 10 wherein said locking member comprises interlockable projections on the upper planar face and said block further including complementary interlockable recesses in the bottom planar face whereby said interlockable projections cooperate with the complementary recesses of the upper block to restrict relative horizontal movement.

13. The concrete block according to claim 10 wherein the locking member extends between said two planar end faces, said locking member comprising an upwardly-sloping ramp terminating in an abutment face which is disposed at a predetermined distance between said rear planar face and said front planar face.

* * * * *

UNITED STATES PATENT AND TRADEMARK OFFICE

CERTIFICATE OF CORRECTION

PATENT NO. : 5,791,827

DATED : August 11, 1998

INVENTOR(S) : Louis Arvai and Charles Chase

It is certified that error appears in the above-identified patent and that said Letters Patent is hereby corrected as shown below:

In claim 1, column 11, line 22, delete "blocs" and insert --block-- therefor.
In claim 7, column 13, line 18, delete "33".
In claim 10, column 14, line 37, after 'from', insert --,--.

Signed and Sealed this

Eighth Day of December, 1998

Bruce Lehman

*Attest:*

BRUCE LEHMAN

*Attesting Officer*

*Commissioner of Patents and Trademarks*